United States Patent [19]

Svekis et al.

[11] 4,381,758

[45] May 3, 1983

[54] IGNITOR CHAMBER FOR GAS GRILL

[75] Inventors: James J. Svekis, Thornhill; John Janez, Scarborough, both of Canada

[73] Assignee: Shepherd Products Limited, Canada

[21] Appl. No.: 285,386

[22] Filed: Jul. 20, 1981

[51] Int. Cl.[3] ..... F24C 3/00

[52] U.S. Cl. ..... 126/41 R; 431/263

[58] Field of Search ..... 431/263, 264; 126/41 R

[56] References Cited

U.S. PATENT DOCUMENTS 4,288,210 9/1981 Leonard et al. ..... 431/263

*Primary Examiner*—Carroll B. Dority, Jr.

*Attorney, Agent, or Firm*—McWilliams, Mann, Zummer & Sweeney

[57] ABSTRACT

The invention relates to an ignitor box, or chamber, for use with a gas fired grill wherein a piezoelectric device strikes a spark that ignites the gas from an adjacent burner. This ignitor chamber is of flared form enclosed on three sides with the fourth side open and facing the burner for admission of gas into the chamber directly from the burner. The top and bottom walls of the chamber are also enclosed, but the top wall is provided with a raised cupola open at opposite ends for the circulation of air:

(1) to effect the admission of oxygen for mixture with the incoming gas from the burner to provide a more combustible mixture for ready ignition when the spark is struck;

(2) also to allow dissipation of combustion gases trapped in the ignitor chamber immediately after combustion.

2 Claims, 6 Drawing Figures

IGNITOR CHAMBER FOR GAS GRILL

BACKGROUND OF THE INVENTION

1. Field of the Invention:

This invention relates to barbecue grills of the type that have been gas fired and equipped with automatic ignition means for lighting the burner.

2. Description of Prior Art:

Heretofore, gas fired barbecue grills have been equipped with ignitor boxes adjacent to the burner which ignited the gas by a spark struck within the ignitor box. This type of ignition box was fully enclosed except for the side disposed toward the burner and worked satisfactorily when the burner was first ignited and the grill was cold, but when the grill was in operation and the burner was hot, if the flame was extinguished by turning if off, or by a wind gust, it became extremely difficult to restart the burner.

This was in all probability due to the accumulation of carbon dioxide in the collector, or possibly due to convection currents that carried the gas straight up from the hot burner and prevented it from flowing into the collector for ignition. The ignition boxes of this type were rectangular and the opening into the box from the burner area did not exceed the total area of the front side of the box so that the effect was to constrict the entrance against the ready flow of gas from the burner into the box.

The lack of sufficient oxygen in the gas mixture entering the enclosed ignitor box prevented the gas from being ignited even though the spark was struck repeatedly because the mixture was not conducive to ignition.

SUMMARY OF THE INVENTION

The present invention provides an ignitor chamber, or collector box, that has the capacity to add oxygen to the gas mixture and includes a cupola atop the box that incorporates openings to induce the flow of air and gas into the collector to provide a proper mixture, including sufficient oxygen from the incoming air to balance the gas entering from the burner area and thereby improve the combustibility of the mixture. The box forming the collector, or ignitor chamber, is of a particular form to improve such circulation and is mounted at its bottom side on an encased ceramic insulated electrode fixture that supports it with its open side toward the gas burner.

The back side of the collector box is closed and the front side is fully open. The two sides of the box also are closed and these side walls are arranged in angled relationship to the back wall so that they flare toward the front side whereby the open front is of greater area than the back side to present a wide mouthed opening toward the burner whereby to facilitate the movement of gas from the burner area into the collector. The bottom side of the collector is enclosed except for an opening closed by the mounting of the encased ceramic insulated electrode fixture and the top side is closed other than the openings in the cupola for circulation of oxygen bearing air into the cupola area. The cupola is formed in the top wall of the collector box directly over the mounting of the encased ceramic insulated electrode so that when a spark is struck for ignition it occurs in the area of the richest mixture in the collector and thereby facilitates immediate ignition of this mixture and lighting of the burner.

The burner and the collector box are mounted in a housing in the form of an enclosure that may include a hinged cover, if desired. The burner is supplied with gas from a venturi tube leading through the bottom wall of the enclosure in the form shown and the gas flowing through the venturi is controlled and regulated by means of a suitable valve that enables the cooking gas to be turned on and off. The encased ceramic insulated electrode fixture supporting the collector box in the housing also is mounted through the bottom wall of the housing and has a wire connection with a suitable source of electric current.

DESCRIPTION OF THE DRAWINGS

The improvements in ignitor chambers afforded by the present invention are achieved by the construction and arrangement illustrated in the accompanying drawings wherein.

DESCRIPTION OF PREFERRED EMBODIMENT

Figure 1:
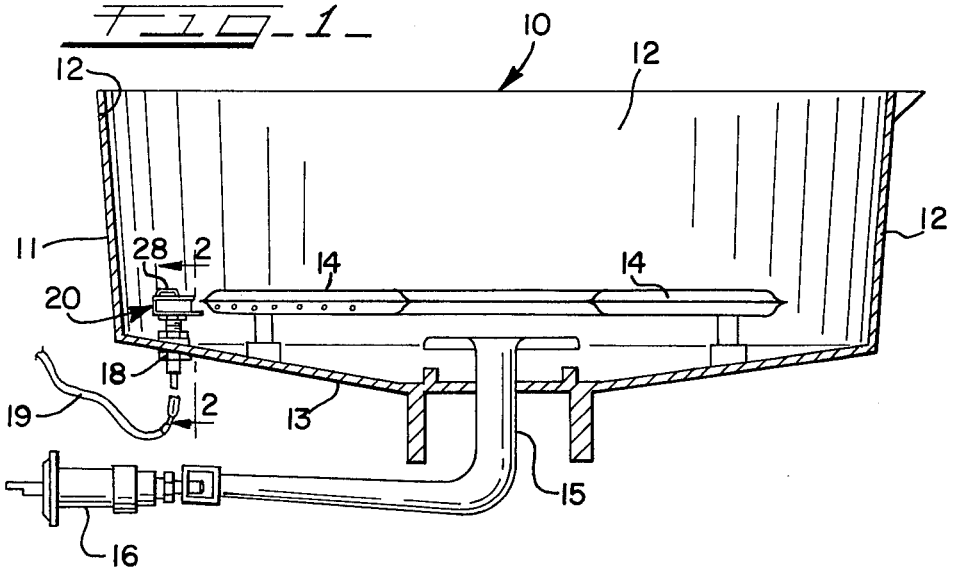
FIG. 1 is a general view in cross section of a barbecue grill incorporating a collector box for an ignitor of the type contemplated by this invention, showing the collector box mounted in a bottom wall of the housing of the grill, in association with a gas burner.

In the drawings, as best shown in FIG. 1, a gas operated barbecue grill is generally indicated by the reference character 10 and which includes a housing 11 that may be constructed of heavy aluminum, or the like, including side and end walls 12 and a bottom wall 13. One or more gas burners 14 are suitably mounted on this bottom wall within the housing by means of cast-in lugs upon which the burners are supported. A venturi tube 15 extends through the bottom wall and supplies cooking gas to the burners 14, which may be propane from a bottle, or tank, or it may comprise natural gas from a typical fixed source where the barbecue grill is permanently mounted. A typical control valve 16 for the gas, regulates the gas passing through the venturi to control the cooking flames on the burners.

Figure 2:
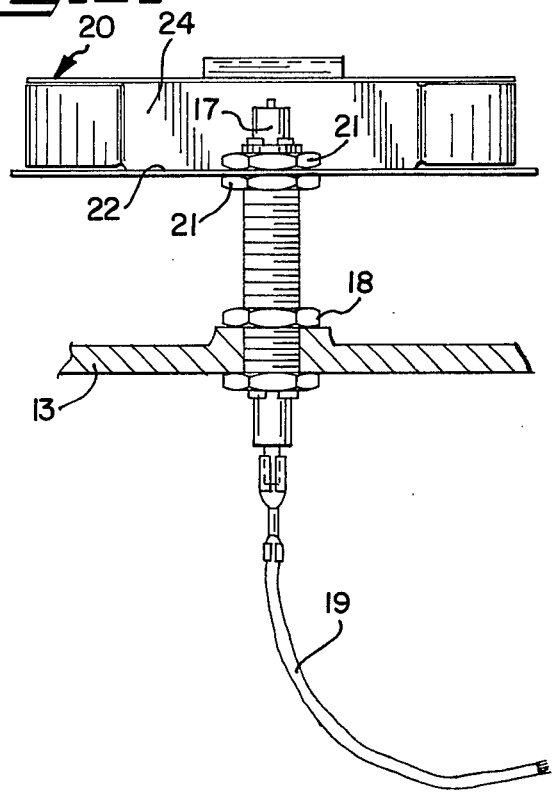
FIG. 2 is a sectional view on the line 2—2 of FIG. 1 through the bottom wall of the grill housing showing the open front collector box mounted on an encased ceramic insulated electrode which in turn is mounted through the bottom wall of the housing.

An encased ceramic insulated electrode starting device 17 is mounted in the bottom wall 13, as at 18, and is connected by a wire circuit 19 to a source of electrical current. A collector box 20, which comprises an ignitor chamber is fixedly mounted on the vertically disposed encased ceramic insulated electrode, as by nuts 21 threaded onto the fixture above and below the bottom wall 22 of the ignitor box. The bottom wall 22 has an opening 23 for passing the fixture 17 therethrough, as best exposed in FIG. 4. The box 20 is rigidly held on the fixture 17, as best revealed by FIG. 2 and as shown in FIG. 1 the box is mounted in close association with the burner assembly 14 so that gas emanating from the adjacent burner can enter the box 20 and be ignited by the sparking of the electrode device 17 which strikes a spark against the roof of the box.

The collector box 20 in addition to the bottom wall 22 includes a rear wall 24, top wall 25 and side walls 26. The front side of the box thus formed and disposed toward the burner assembly 14, remains fully open so that the box is fully exposed to the flow of gas from the burners 14 into the interior of the box where it can be ignited by the sparking of the electrode device 17.

Figure 3:
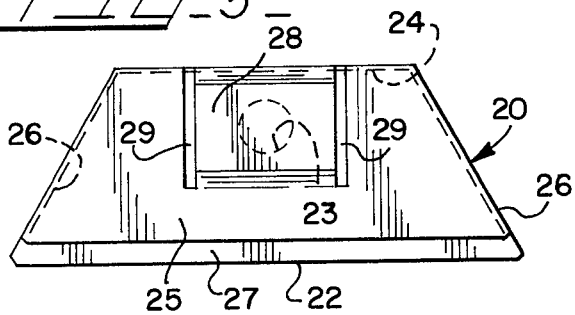
FIG. 3 is a top plan view of the collector box to larger scale, showing the cupola atop the box and clearly revealing the flared shape of the box.
Figure 4:
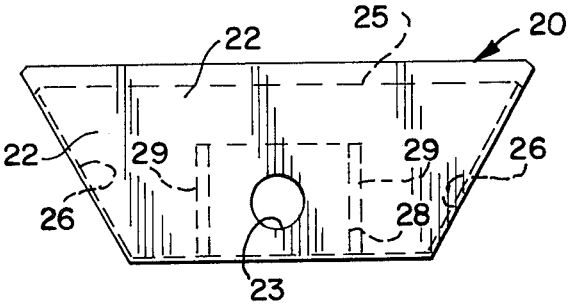
FIG. 4 also shows the flared shape of the collector box and comprises a bottom plan view of the box with the hole revealed for the encased ceramic insulated electrode fixture.

To facilitate the entrance of gas from the burners into the box the side walls 26 are flared outwardly, as best shown in FIGS. 3 and 4, which affords a wide mouthed open front side into which the burner gas is readily able to flow to reach the inner ignitor area of the box 20. The flow of the gas into the collector box is aided also by the extended front lip 27 of the bottom wall 22 of the collector box 20. This lip is disposed more closely adjacent to the burner 14 to prevent any possibility of the gas flowing from the burner escaping downwardly between the side of the burner and the collector box and thus causing the gas to flow in its entirety into the collector.

This flow of gas into the collector is further enhanced by the provision of a vented cupola 28 on the top wall of the collector chamber. The cupola vents comprise openings 29 in respectively opposite ends of the cupola whereby to induce a flow-through circulation. The cupola 28 comprises an integral raised roof portion in the top wall 25 forming a generally rectangular vault on the top of the cupola so that the opposite openings 29 are disposed above the level of the top wall and thereby affording ready admission of air into the cupola.

Figure 5:
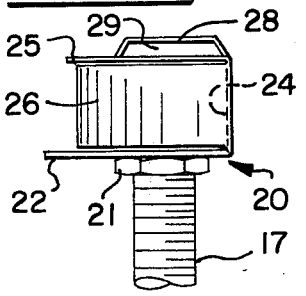
FIG. 5 is a side elevational view of the ignitor chamber and clearly showing the cupola structure on top with flow through end openings for the admission of oxygen contained in air circulating into the interior of the box.

As best indicated in FIG. 5, it should be noted that the cupola 28 is located directly over the electrode fixture 17 so that when a spark is struck against the roof of the cupola for ignition of gas accumulated in the collector, it will occur in the raised cupola area directly in the midst of the richest pocket of gas mixture accumulated from burner gas and the oxygen laden incoming air from the cupola vents 29.

This location of the fixture 17 assures immediate ignition of the gas mixture both when the barbecue grill is first lighted with the burners 14 cold and also when the hot burners are relighted after being extinguished for any reason. Location of the cupola overhead in the collector chamber 20 with vent openings admitting air from this position has been found to greatly improve the ability of the ignitor to light the gas mixture when the burners 14 are hot and it becomes necessary to relight the grill.

Figure 6:
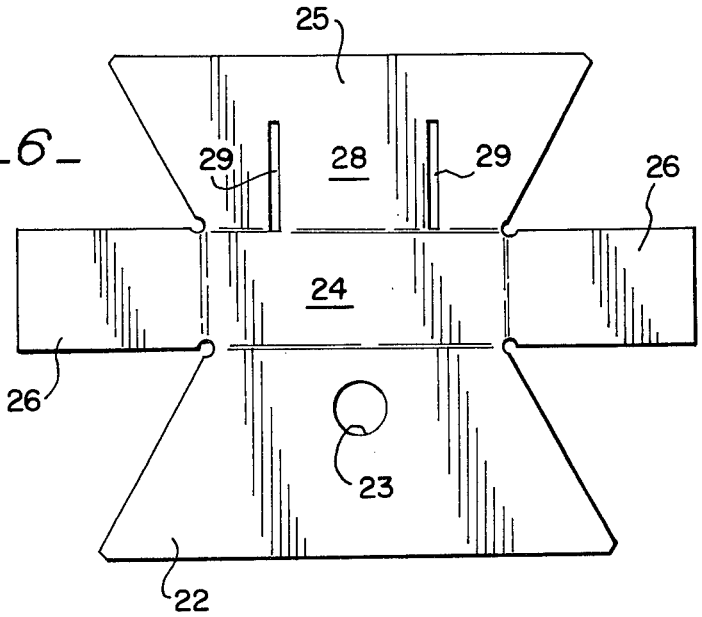
FIG. 6 is a view of the collector box being folded.

The collector chamber 20 is preferably constructed from stainless steel for durability in the type of service to which it is subjected and can be made in one piece and formed to provide the enclosed collector chamber shown in FIGS. 3–5. A blank is shown in FIG. 6 from which the collector chamber can be formed. The blank is illustrated in the flat in this view and is shown after the stainless steel sheet from which the chamber is made has been blanked to provide in one operation the contoured steel sheet including the several walls 22, 24, 25 and 26 integrally formed and with the top and bottom walls shaped at their end edges where they meet the side walls 26 to provide the flaring chamber 20 when the several walls are brought into final position.

The cupola chamber 28 and the vent openings 29 can be formed simultaneously with this blanking operation and the hole 23 as well, so that the next step comprises a bending operation wherein the several walls 22, 25 and 26 are bent at the fold lines defined by the outline of the rear wall 24. The top and bottom walls are folded over and the end walls 26 are folded to angular positions where they will be disposed substantially aligned with the edges of the top and bottom walls.

All of these bends can be performed in a single operation, which is facilitated by the wide mouthed flaring construction of the collector box. It should be noted in the final bended position of the several walls that the end walls are disposed between the top and bottom walls so that the walls 25 and 22 respectively overlie the end walls at their top edges and disposed under the end walls at the bottom edges of the walls 26.

Thus folded, the integral blank forms a flaring open mouth collector chamber for mounting on the electrode fixture 17 with the open mouth disposed facing the burners 14 to collect gas flowing therefrom and with the cupola 28 disposed over the fixture 17 a spark generated in this area will readily ignite the gas mixture from the burner as enriched by the incoming air and oxygen through the cupola openings 29 and the circulation of air through the vents 29 will induce the flow of gas from the burners to move into the collector chamber 20.

From the foregoing, it will be seen that an ignitor for a gas barbecue grill has been provided wherein the fuctioning of a gas collector box has been improved by the construction of the collector with an open front mouth of greater width than the rear of the box, so that the collector assumes a flared shape and which utilizes a cupola on the roof of the collector directly over the electrode sparking device, with vents in the cupola to bring in air and oxygen to enrich the gas mixture for ready ignition and which vented cupola increases the flow of gas from the burner area into the collector and provides ignition of the gas mixture whether the burner is hot or cold.

What is claimed is:

1. An ignitor for a gas barbecue grill having a gas burner and means for supplying gas to the burner, a collector box mounted in the grill in association with said burner, said box having an open mouth facing the burner for admitting gas emanating from the burner, said open mouth being of greater area that the rear wall of the collector box with the box having a flaring shape to facilitate movement of gas from the burner into the collector box, an ignition device adapted to ignite said gas mounted in the grill and extending into said box, said box provided with a cupola comprising a generally rectangular vault formed integrally with a top wall of said collector box and extending above the top wall, and vent openings in opposite sides of the vault, said ignition device being located directly under the area of said cupola and strikes a spark in said area.

2. An ignitor for a gas barbecue grill as set forth in claim 1 wherein said collector box has a rear wall, top and bottom walls extending forwardly from the rear wall and having side edges which flare toward the front of the box, and a pair of side walls extending forwardly from the rear wall at angles corresponding with the flared side edges of the top and bottom walls, said side walls being disposed between the top and bottom walls, all of said walls being of one piece integral construction and the side edges of said top and bottom walls being substantially aligned with said side walls and free of attachment to the side walls.

* * * * *